US007758439B2

(12) United States Patent
Roenick

(10) Patent No.: US 7,758,439 B2
(45) Date of Patent: Jul. 20, 2010

(54) ADJUSTABLE ALIGNMENT GOLF PUTTER

(76) Inventor: Harry Anthony Roenick, 2200 Toniwood La., Palm Harbor, FL (US) 34685

( * ) Notice: Subject to any disclaimer, the term of this patent is extended or adjusted under 35 U.S.C. 154(b) by 0 days.

(21) Appl. No.: 12/290,338

(22) Filed: Oct. 29, 2008

(65) Prior Publication Data

US 2009/0118035 A1 May 7, 2009

Related U.S. Application Data

(60) Provisional application No. 61/001,851, filed on Nov. 5, 2007.

(51) Int. Cl.
*A63B 69/36* (2006.01)

(52) U.S. Cl. ..... 473/238; 473/242; 473/244; 473/251

(58) Field of Classification Search ..... 473/219–256; D21/736–746
See application file for complete search history.

(56) References Cited

U.S. PATENT DOCUMENTS

| | | | | | |
|---|---|---|---|---|---|
| 1,039,491 | A * | 9/1912 | Collins | 473/233 |
| 1,173,384 | A * | 2/1916 | Rees | 473/251 |
| 1,536,512 | A * | 5/1925 | McLaren | 473/238 |
| 1,659,231 | A * | 2/1928 | Baack | 473/251 |
| 3,033,574 | A * | 5/1962 | Partridge | 473/251 |
| 3,199,873 | A * | 8/1965 | Surratt | 473/251 |
| 3,292,928 | A * | 12/1966 | Billen | 473/244 |
| 3,298,693 | A * | 1/1967 | Eisenberg | 473/238 |
| 3,529,830 | A * | 9/1970 | Palotsee | 473/244 |
| 3,719,363 | A * | 3/1973 | Harrison | 473/228 |
| 3,979,125 | A * | 9/1976 | Lancellotti | 473/233 |
| 4,291,883 | A * | 9/1981 | Smart et al. | 473/244 |
| 4,688,798 | A * | 8/1987 | Pelz | 473/249 |
| 4,819,943 | A * | 4/1989 | Szczepanski | 473/252 |
| 5,160,142 | A * | 11/1992 | Marshall | 473/241 |
| 5,429,366 | A * | 7/1995 | McCabe | 473/244 |
| 5,447,313 | A * | 9/1995 | Finley | 473/244 |
| 5,839,970 | A * | 11/1998 | Lombardo | 473/252 |
| 6,471,600 | B2 * | 10/2002 | Tang et al. | 473/242 |
| 6,506,125 | B2 * | 1/2003 | Helmstetter et al. | 473/242 |
| 6,558,268 | B2 * | 5/2003 | Tindale | 473/244 |
| 6,679,782 | B2 * | 1/2004 | Tang et al. | 473/242 |
| 6,793,588 | B2 * | 9/2004 | Tang et al. | 473/242 |
| 6,949,028 | B1 * | 9/2005 | Hueber | 473/242 |
| 7,384,345 | B2 * | 6/2008 | Sherman | 473/249 |

* cited by examiner

*Primary Examiner*—Sebastiano Passaniti
(74) *Attorney, Agent, or Firm*—Arthur W. Fisher, III

(57) ABSTRACT

An adjustable alignment golf putter to compensate for a golfer's visual misalignment of the putter face due to eye predominance to the intended or target line taking into account the slope and contour of the green comprising an upper golf grip and a lower putter head attached to opposite end portions of a putter shaft, the putter head includes visual alignment means formed on the side opposite the putter face including a visual alignment base to support an adjustable alignment element movably positioned thereon to selectively align the adjustable alignment element on a virtual line between the optimum contact point and the cup angularly off set relative to the intended or target line between the golf ball and cup to compensate for the golfer's visual misalignment when putting the golf ball along the intended line to the cup.

16 Claims, 9 Drawing Sheets

ADJUSTABLE ALIGNMENT GOLF PUTTER

CROSS-REFERENCE

This is a utility application of provisional application Ser. No. 61/001,851 filed Nov. 5, 2007.

BACKGROUND OF THE INVENTION

1. Field of the Invention

An adjustable alignment golf putter including an adjustable visual alignment indicia to correct or compensate for a golfer's visual misalignment of the putter face to the desired target line or intended line between the optimum contact point on the putter face and the cup.

2. Description of the Prior Art

Numerous golf putters designs have been developed in an effort to improve a golfer's putting accuracy. Such designs include curved-shafted putters, putters with shaft offsets and mallet-like putters.

Regardless, eye predominance commonly causes golfers to misalign putts. Thus, a putter that allows a golfer to align the putt to the virtual line between the golf ball and cup with the putter face perpendicular to the line the golfer could stroke the golf ball along the actual line between the golf ball and cup.

Of course, other sources of visual misalignment such as convergence and triangulation can contribute to a golfer misaligning a putt.

To allow for such alignment some putters include indicia placed on the top of the putter head to be viewed by the golfer when in the putting stance. These indicia generally comprise one or more straight or curved lines set at different angles on the club.

Some putters of the prior art take the golfer's sighting error from eye predominance into consideration and provide for a one-time adjustment of the putter for all putts. The one-time sighting adjustment made to these clubs may be helpful for long putts, but such an adjustment does not provide a golfer with maximum alignment efficiency for shorter putts and may actually compound the putting error in distances shorter than, for instance, ten feet.

U.S. Pat. No. 3,199,873 show a sighting stripe comprising as an anodized aluminum color on its upper surface and etched on the lower surface coated with a pressure sensitive adhesive to form a tight bond on the club head. The forward end of the stripe is rounded and the side edges are parallel.

U.S. Pat. No. 4,291,883 relates to a device attachable to a golf club comprising a plate with a removable sight rod secured to the top of the putter blade. The device includes a plurality of recesses in the plate spaced in degrees of angle for setting the angle of the rod to any desired position by a spring-urged ball in the pivotal portion of the sight rod.

U.S. Pat. No. 5,429,366 shows a sight corrected golf club comprising golf head and a module having an alignment indicia thereon. The golf head is configured to receive the module which is preferably secured to the golf head at the time the golf club is sold to an ultimate purchaser.

U.S. Pat. No. 5,839,970 discloses a mallet-type putter comprising an upper surface with an indicia in the form of a first long line, a second short line, and a series of even shorter lines extending from the end of the short line and sweeping rearward in a curved arc to become parallel with the first long line. In order to compensate for a golfer's sighting error resulting from eye predominance, the long line is arranged to align putts that are ten feet or longer in distance from the golf ball to the putting cup. The short line and an array of shorter lines are arranged to align putts that are shorter than ten feet in distance from the golf ball to the putting cup.

U.S. Pat. No. 6,558,268 relates to the head of a mallet-type putter similar to U.S. Pat. No. 5,839,970.

U.S. Pat. No. 6,949,028 shows a golf putter having visual indicia comprises a D-shape with the back line linear portion parallel to the clubface and the arc portion facing forward toward the clubface with a linear alignment line disposed within the arc and back line such that the alignment line is angled a slight amount away from perpendicular to the back line such that the golfer falsely perceives the alignment line to be perpendicular to the clubface.

Additional examples of the prior art can be found in U.S. Pat. Nos. 4,688,798; 6,471,600; 6,506,125; 6,679,782 and 6,793,588.

SUMMARY OF THE INVENTION

The present invention relates to an adjustable alignment golf putter to correct or compensate for the visual error or misalignment of the intended or target line and the visualized or virtual putt line between the golf ball and cup comprising an upper golf grip and a lower putter head attached to opposite end portions of a putter shaft.

The lower putter head comprises a putter body including a putter face having a centrally disposed optimum contact point or area on one side or front thereof and a visual alignment means on the opposite side or back thereof.

The visual alignment means comprises an alignment support or base extending outwardly from the back of the putter body and a visual alignment indicator movably disposed or mounted thereon together with an indicator retention member to selectively secure the visual alignment indicator in place relative to the alignment support or base and the putter body. The visual alignment indicator comprises an elongated member.

The visual alignment means further includes an alignment indicator guide to control the directional movement of the visual alignment indicator relative to the alignment support or base. The alignment indicator guide comprises an arcuate guide recess formed in the upper surface of the alignment support or base and a corresponding arcuate guide member extending downwardly from the elongated member at least partially disposed within the convex guide recess.

The indicator retention member comprises a fastener to selectively secure the position of the elongated member of the visual alignment indicator on the alignment support base.

A visual index may be formed on the distal end portion of the alignment support or base comprising a plurality of equally spaced index markers or indicia to indicate the angular displacement relative to one another on both sides of a center index mark or indicia aligned with the centrally disposed optimum contact point or area.

The adjustable alignment golf putter provides a golfer with a means or method of aligning the adjustable alignment golf putter to the align the putter face along the actual intended or target line between the golf ball and cup and the visualize line between the golf ball and the cup the golfer sees and have the golf ball actually move along the intended line of the putt to the cup. This is accomplished by aligning elongated member of the adjustable alignment golf putter with the putter face to compensate for the perceived alignment due to eye predominance.

Once the adjustable alignment golf putter is properly aligned, the golfer simply aligns the offset elongated member held in place by the indicator retention member with the cup and stroke the putt down that line with no compensation made in his stroke for misalignment.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

DETAILED DESCRIPTION OF THE PREFERRED EMBODIMENT

Figure 1:
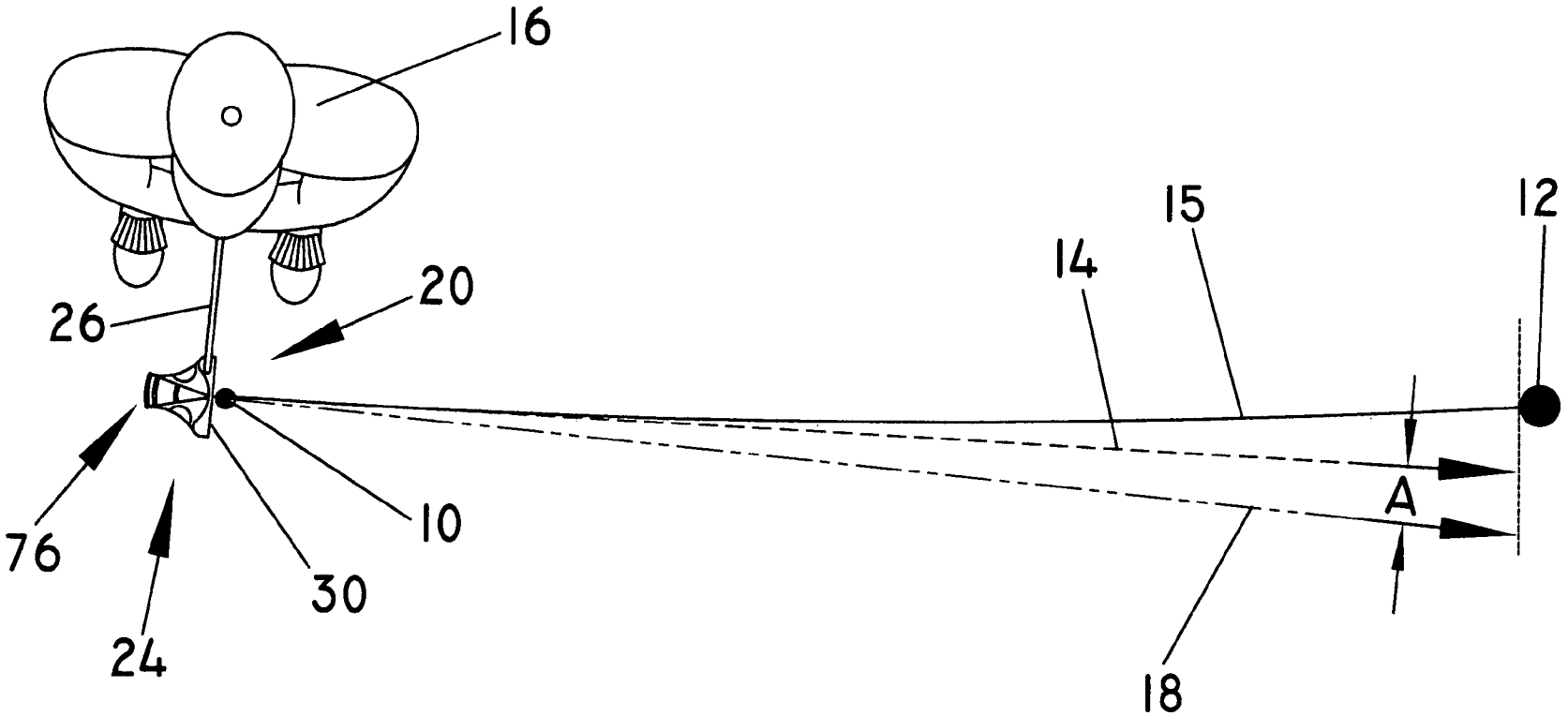
FIG. 1 is a view illustrating sighting error or misalignment of a putt due to eye predominance.

FIG. 1 illustrates the sighting error a golfer experiences due to eye predominance or other source of visual misalignment. Specifically, the intended or target line 14 between the golf ball 10 and the cup 12 is determined by the slope and contour of the green that when the golf ball 10 is stroked or putted properly, the golf ball 10 will follow the putt line 15. However, the golfer 16 views or sees the intended or target line 14 as a visualized putt line 18 offset thereto by angle A. As described hereinafter, the present invention relates to an adjustable alignment golf putter shown generally as 20 to correct or compensate for the visual error or misalignment of the true or actual putt line 14 and the virtual putt line 18.

Figure 2:
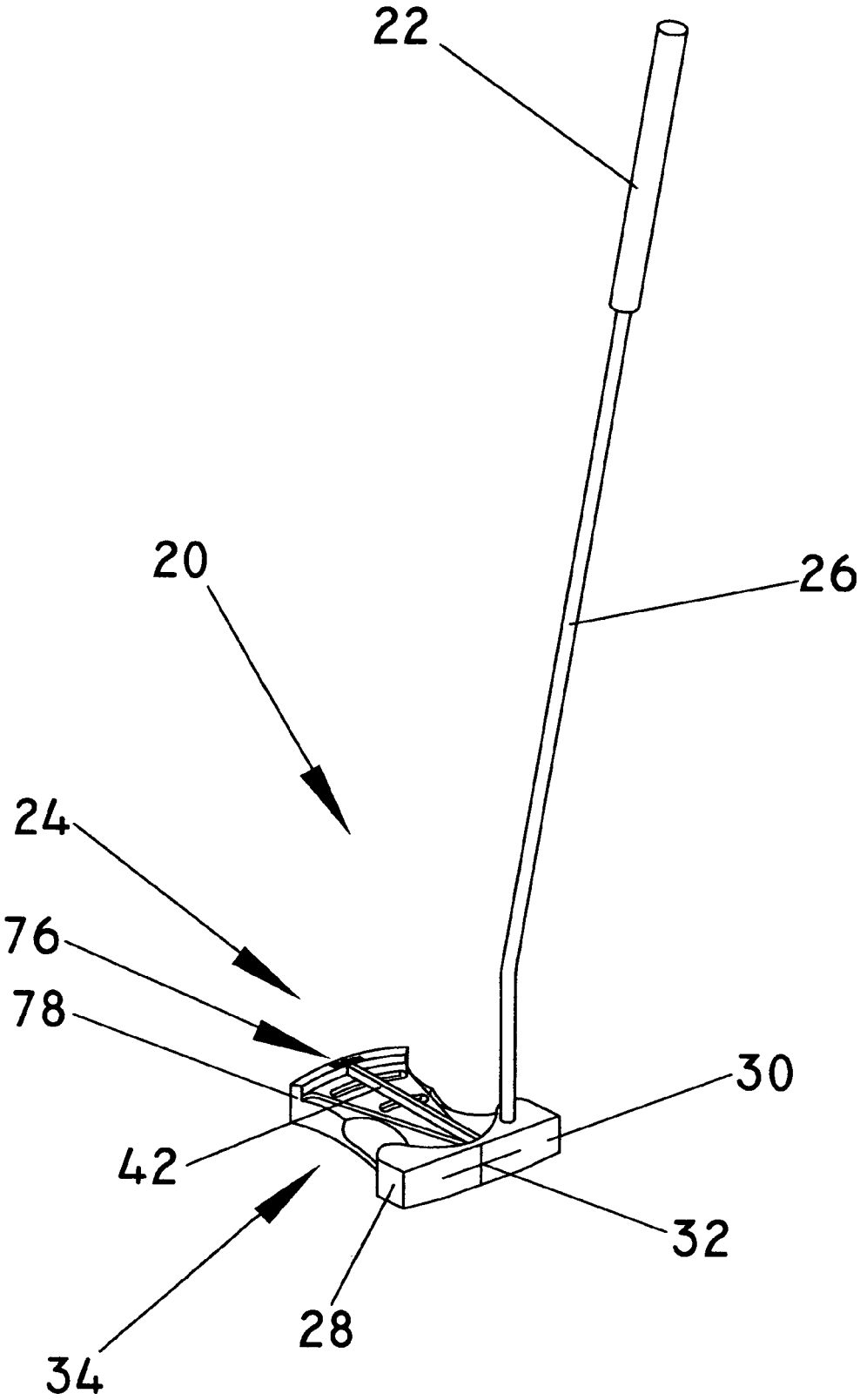
FIG. 2 is a perspective of the adjustable alignment golf putter of the present invention.

As shown in FIG. 2, the adjustable alignment golf putter 20 comprises an upper golf grip 22 and a lower putter head generally indicated as 24 attached to opposite end portions of a putter shaft 26.

Figure 3:
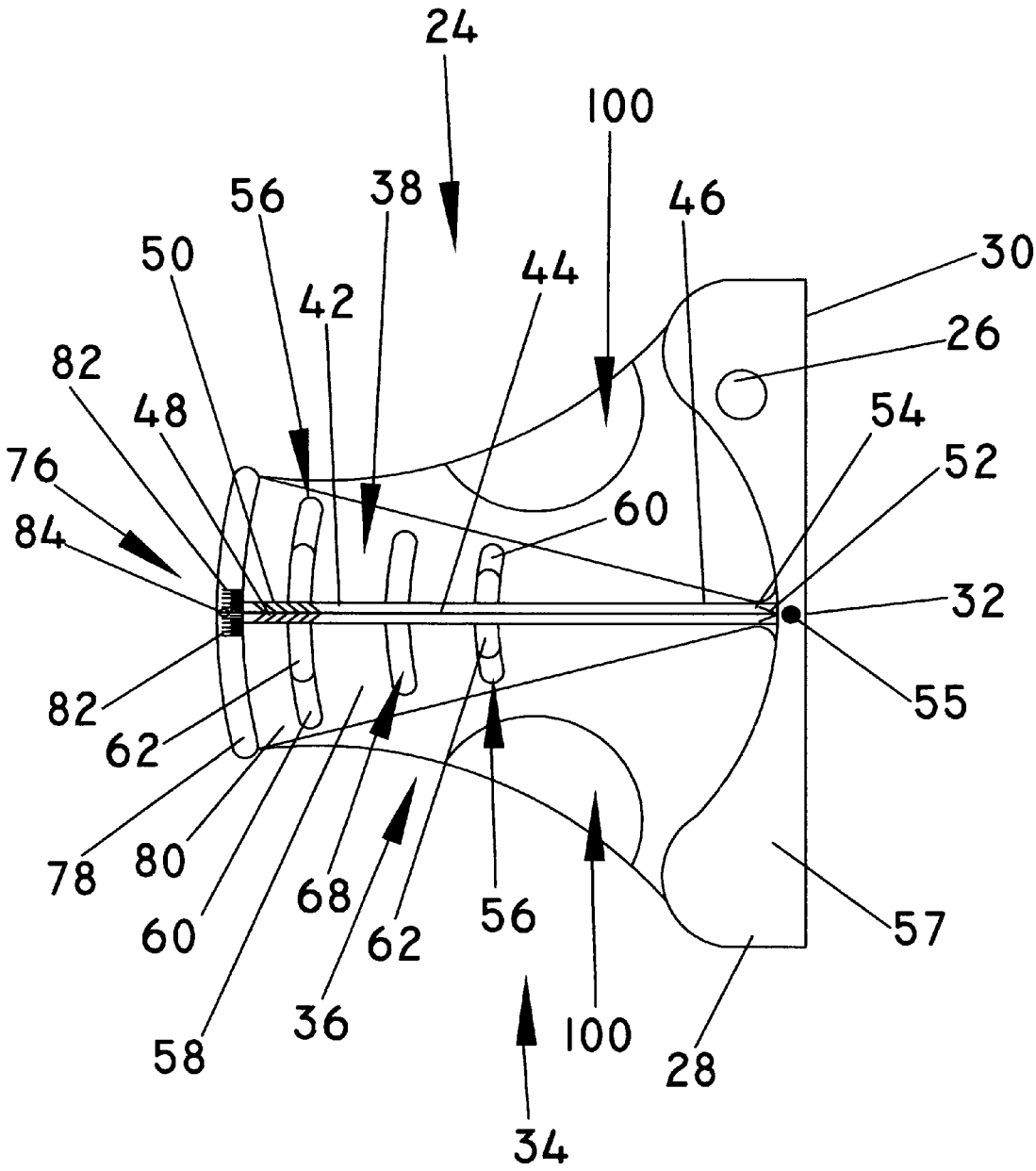
FIG. 3 is a top view of the putter head of the adjustable alignment golf putter of the present invention.
Figure 4:
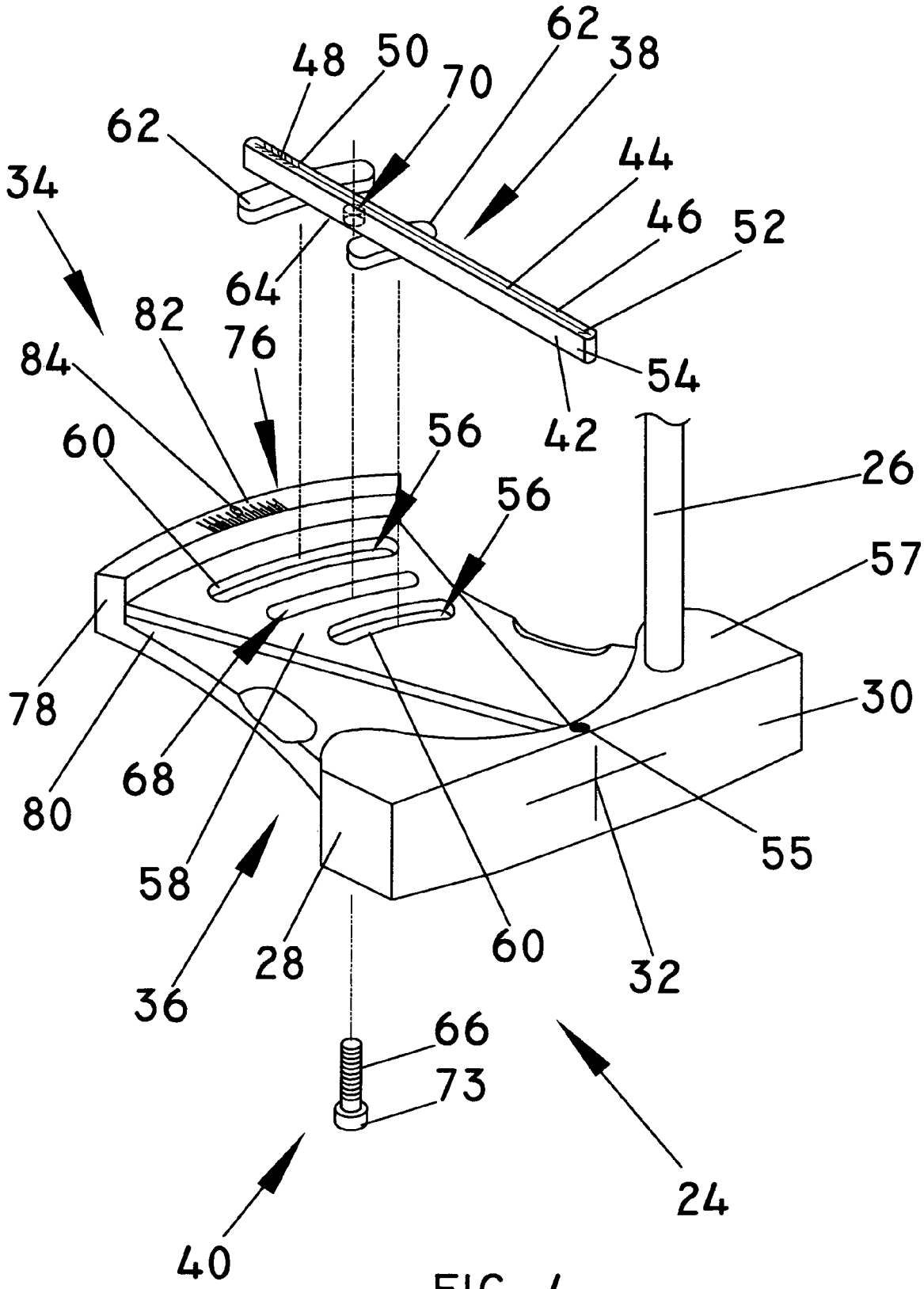
FIG. 4 is an exploded perspective view of the putter head of the adjustable alignment golf putter of the present invention.

As best shown in FIGS. 2 through 4, the lower putter head 24 comprises a putter body 28 including a putter face 30 having a centrally disposed optimum contact point or area 32 on one side or front thereof and a visual alignment means generally indicated as 34 on the opposite side or back thereof.

As best shown in FIGS. 3 and 4, the visual alignment means 34 comprises an alignment support or base generally indicated as 36 extending outwardly from the back of the putter body 28 and a visual alignment indicator generally indicated as 38 movably disposed or mounted thereon together with an indicator retention member generally indicated as 40 to selectively secure the visual alignment indicator 38 in place relative to the alignment support or base 36 and the putter body 28. The visual alignment indicator 38 comprises an elongated member 42 having an elongated line or groove 44 on the upper surface 46 thereof including a directional indicia 48 formed on the distal end portion 50 thereof and a pointer indicia 52 formed on the proximal end portion 54 thereof to align the putter face 30 as described hereinafter. An alignment contact indicia 55 such as a dot is formed on the top surface 57 of the putter body 28 in substantially vertical alignment relative to the centrally disposed optimum contact point or area 32.

Figure 4A:
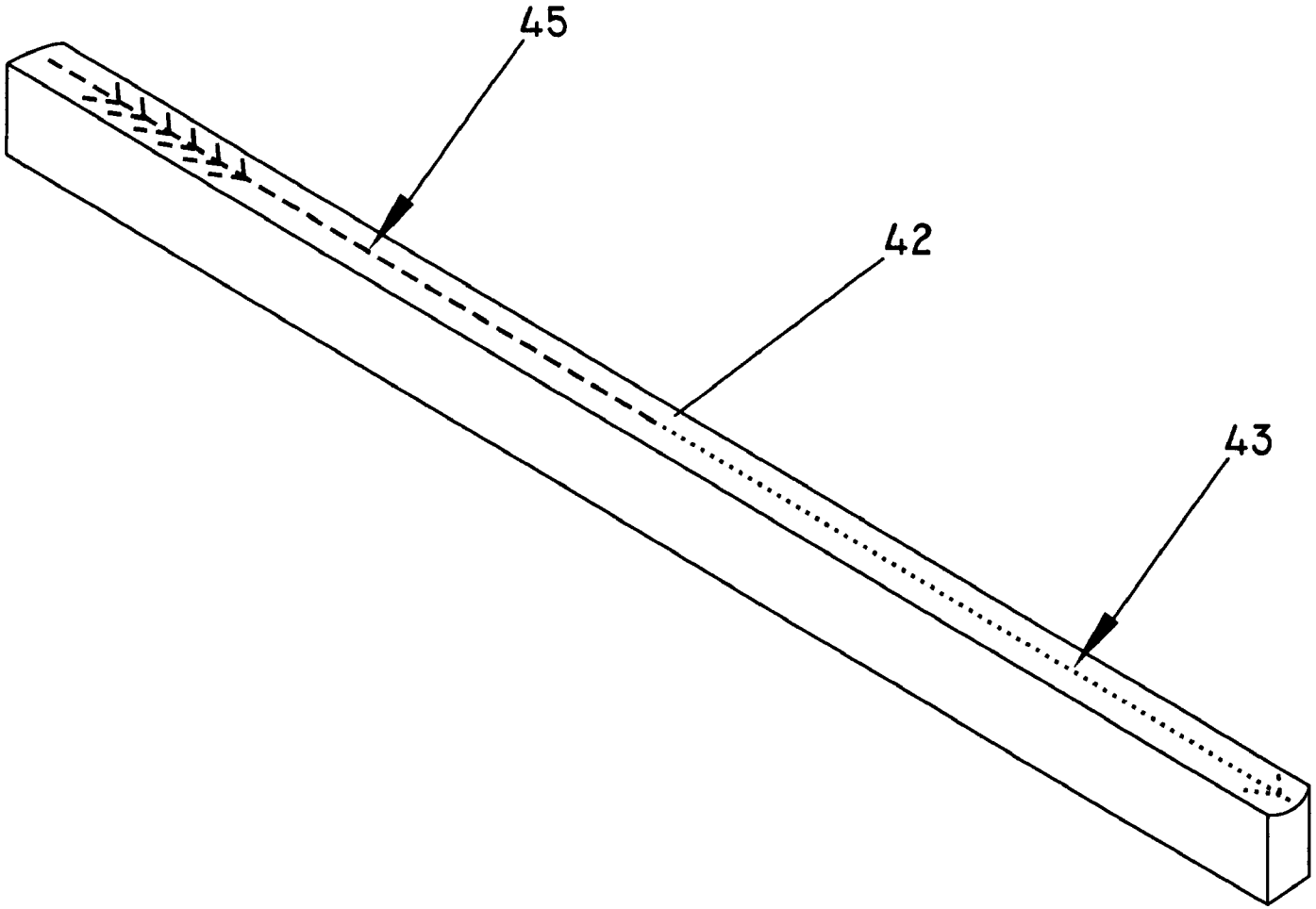
FIG. 4A is a perspective view of an alternate embodiment of the visual alignment indicator of the adjustable alignment golf putter of the present invention.

As best shown in FIGS. 3 and 4, the visual alignment means 34 further includes an alignment indicator guide to control the directional movement of the visual alignment indicator 38 relative to the alignment support or base 36. The alignment indicator guide comprises at least one arcuate or convex keyway or guide recess 56 formed in the upper surface 58 of the alignment support or base 36 including a substantially flat inner or bottom support surface 60 and a corresponding arcuate or convex key or guide member 62 extending downwardly from the lower surface 64 of the elongated member 42 of the visual alignment indicator 38 at least partially disposed within the convex keyway or guide recess 56 and supported on the substantially flat inner or bottom support surface 60 thereof. The arcuate or convex key or guide member 62 is symmetrically disposed on the elongated member 42 and the arcuate or convex keyway or guide recess 56 is symmetrically disposed on the upper surface 58 of the alignment support or base 36 such that when the arcuate or convex key or guide member 62 is centered in the arcuate or convex keyway or guide recess 56, the elongated member 42 and the elongated line or groove 44 are substantially perpendicular to the putter face 30. The arcuate or convex keyway or guide recess 56 is slightly larger than the arcuate or convex key or guide member 62 to provide smooth movement or swing of the elongated member 42 relative to the alignment support or base 36 when adjusting or aligning the elongated member 42 of the visual alignment indicator 38. As shown, two alignment indicator guides may be used. In addition, as shown in FIG. 4A, it should be noted that a series of dots 43 or an interrupted or broken line 45 or other alignment indicator may be substituted for the elongated line or groove 44.

Figure 5:
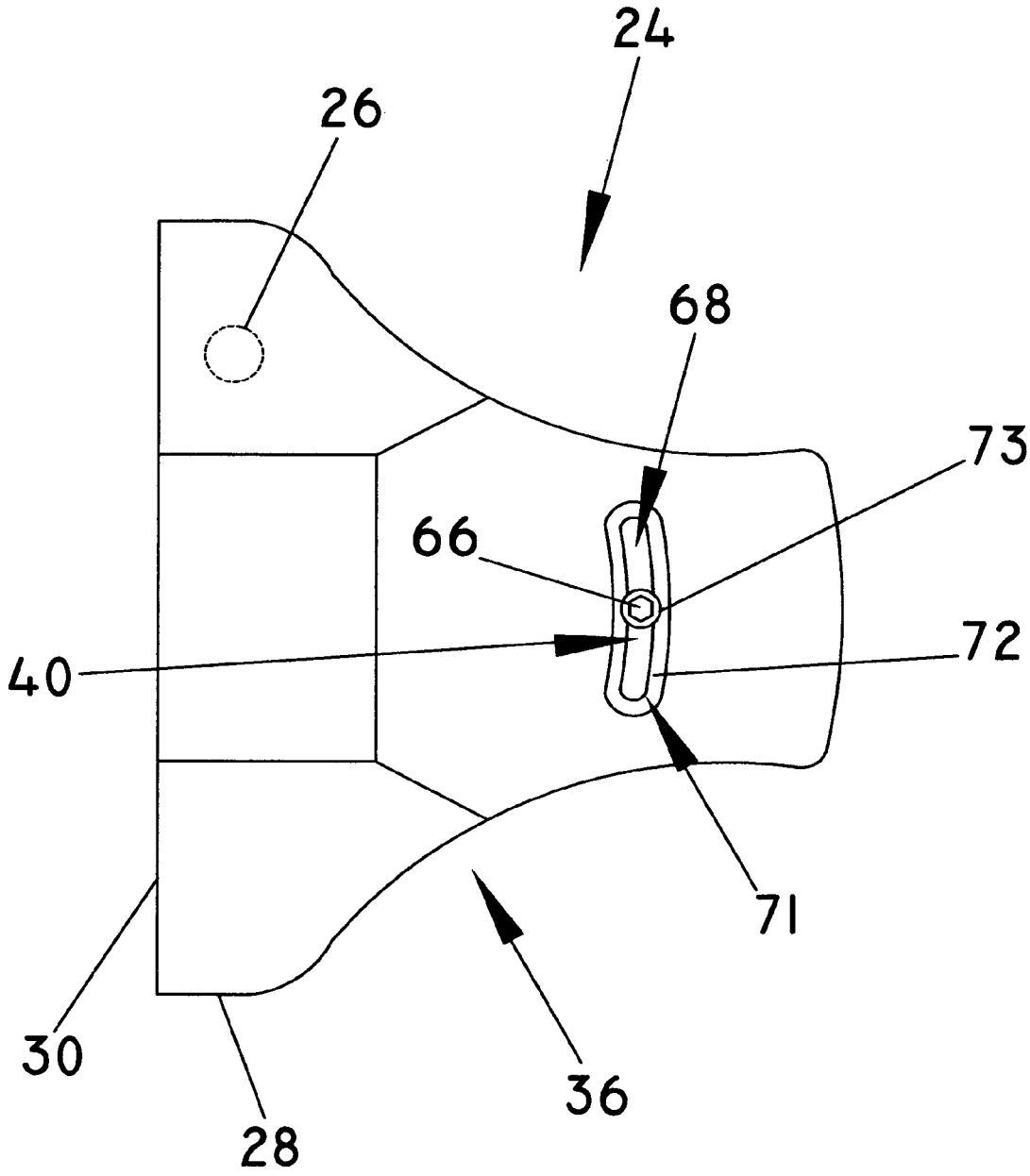
FIG. 5 is a bottom view of the putter head of the adjustable alignment golf putter of the present invention.

As best shown in FIGS. 4 and 5, the indicator retention member 40 comprises a fastener 66 such as an externally threaded member or screw dimensioned to extend through a retention slot or channel 68 formed through the alignment support or base 36 and into an internally threaded recess 70 to selectively secure the position of the elongated member 42 of the visual alignment indicator 38 on the alignment support or base 36. As shown in FIG. 5, a countersunk recess 71 having a recessed surface 72 is formed about the periphery of the retention slot or channel 68 to receive and engage an enlarged head or stop 73 of the fastener 66 to selectively secure the elongated member 42 of the visual alignment indicator 38 in place when the elongated member 42 of the visual alignment indicator 38 relative to the centrally disposed optimum contact point or area 32 is properly aligned. So configured, the enlarged head or stop 73 is disposed within the countersunk recess 71.

As shown in FIGS. 2 through 4, a visual index generally indicated as 76 is formed on a raised plate or putter foot 78 on the distal end portion 80 of the alignment support or base 36. The visual index 76 comprises a plurality of equally spaced index markers or indicia each indicated as 82 to indicate the angular displacement relative to one another on both sides of a center index mark or indicia 84 aligned with the centrally disposed optimum contact point or area 32.

The adjustable alignment golf putter 20 provides a golfer 16 with a means or method of aligning the adjustable alignment golf putter 20 to the visualized or incorrect line 18 the golfer 16 sees and have the golf ball 10 actually move along the correct line 15 of the putt to the cup 12. This is accomplished by the golfer 16 aligning the adjustable alignment golf putter 20 on the visualized line 18 of the putt with the putter face 30 of the adjustable alignment golf putter 20 is actually aligned perpendicular to the intended or target line 14 of the putt between the golf ball 10 and the cup 12.

There are several techniques of adjusting or off-setting the alignment to correct for visual misalignment. For example, to adjust or align the elongated member 42 of the visual alignment indicator 38, the golfer 16 loosen the fastener 66 and aligns the elongated line or groove 44 of the elongated member 42 with the center index mark or indicia 84 and tightens the fastener 66 to secure the elongated member 42 in place perpendicular to the putter face 30. The golfer 16 then visually aligns the directional indicia 48 with the center of the cup 12 from 20 to 30 feet away on a substantially straight and level part of the green. From behind the golfer 16, a second person visually observes where the elongated line or groove 44 is actually pointed. The virtual line or visual extension of the elongated line or groove 44 is mark near the cup 12 with a tee or similar mark. The person then returns to behind the golfer 16 to confirm the tee is on the virtual or visualized line 18.

The golfer 16 then loosens the fastener 66 and aligns the elongated line or groove 44 of the elongated member 42 with the cup 12. The fastener 66 should be tightened securing or locking the elongated member 42 in place relative to the putter body 28.

Once the adjustable alignment golf putter 20 is properly aligned, the golfer 16 simply aligns the elongated line or groove 44 with the cup 12 and strokes the golf ball 10 with no compensation made in his stroke for misalignment. The golfer 16 should not look at the putter face 30 when aligning the putt. The golfer 16 should focus only on the elongated line or groove 44 of the visual alignment indicator 38 on the adjustable alignment golf putter 20.

Figure 6:
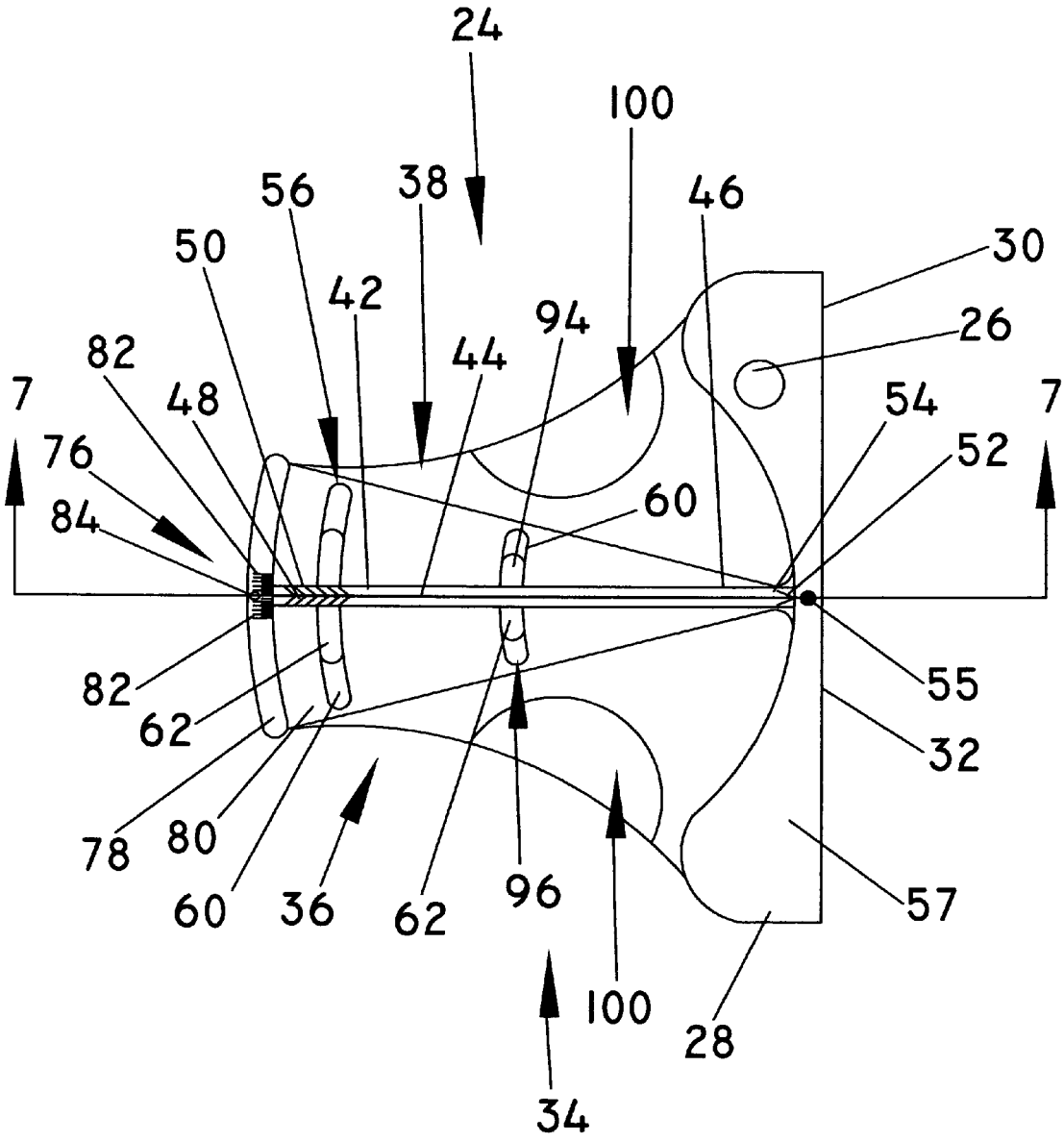
FIG. 6 is a top view an alternate embodiment of the putter head of the adjustable alignment golf putter of the present invention.
Figure 7:
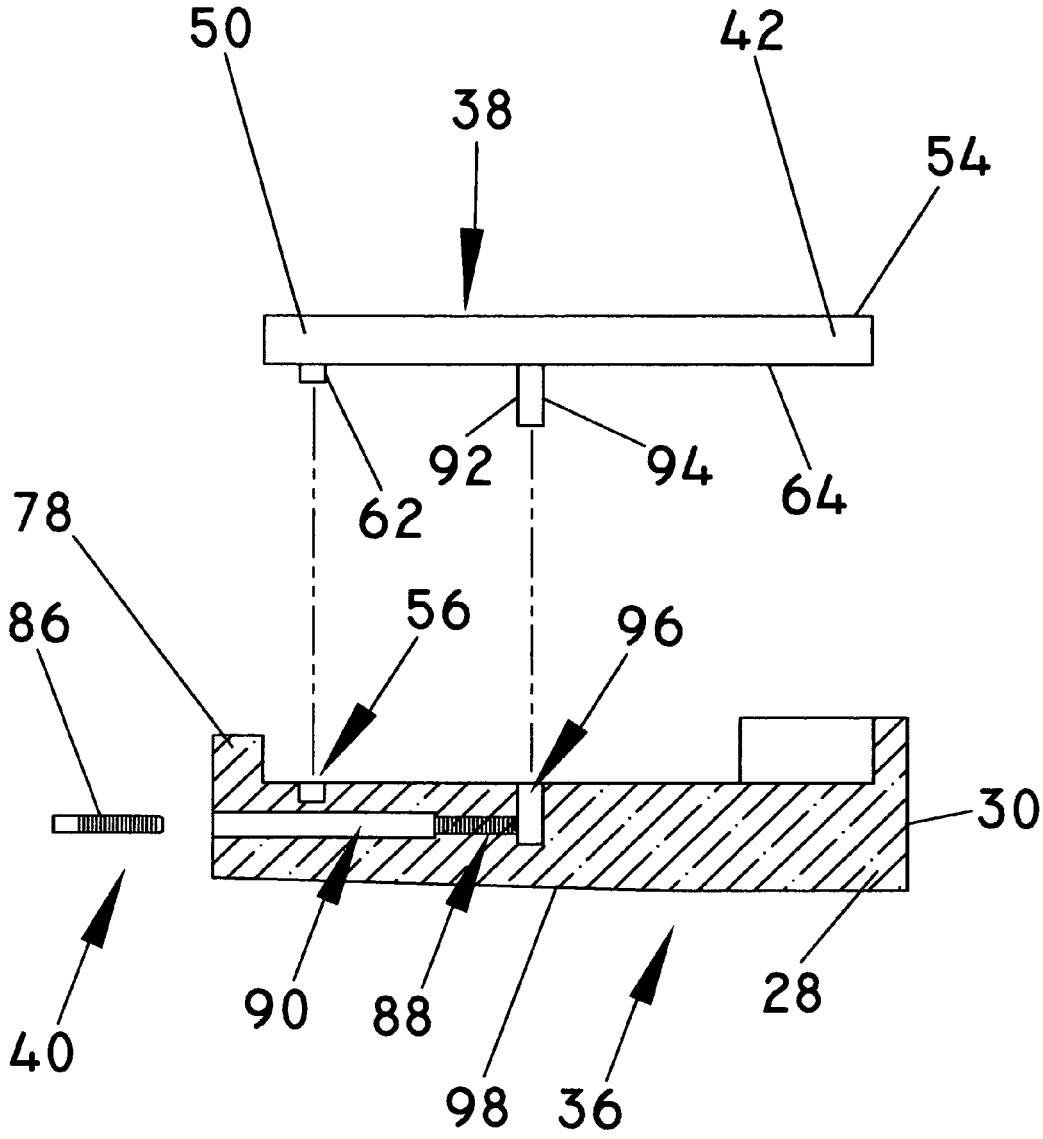
FIG. 7 is a cross-sectional side view of the alternate embodiment of the putter head of the adjustable alignment golf putter of the present invention taken along line 7-7 of FIG. 6.
Figure 8:
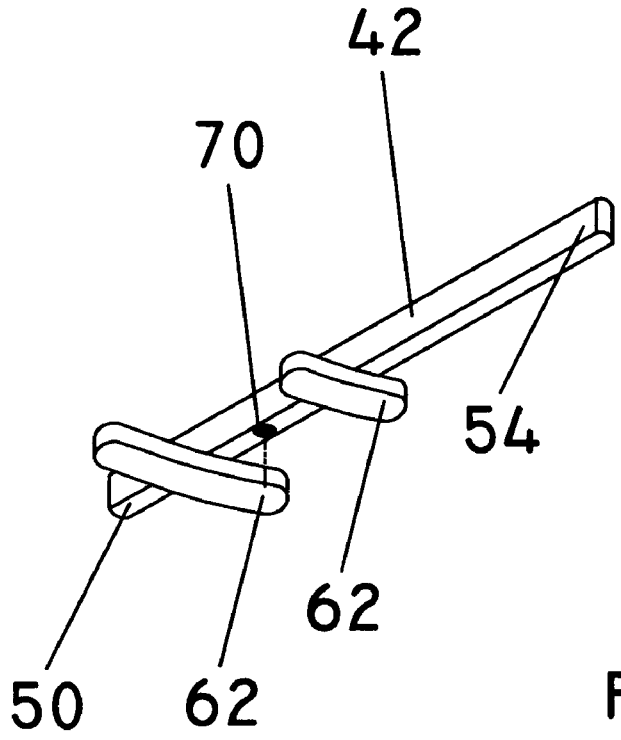
FIG. 8 is a perspective bottom view of the visual alignment indicator of the adjustable alignment golf putter of the present invention.
Figure 9:
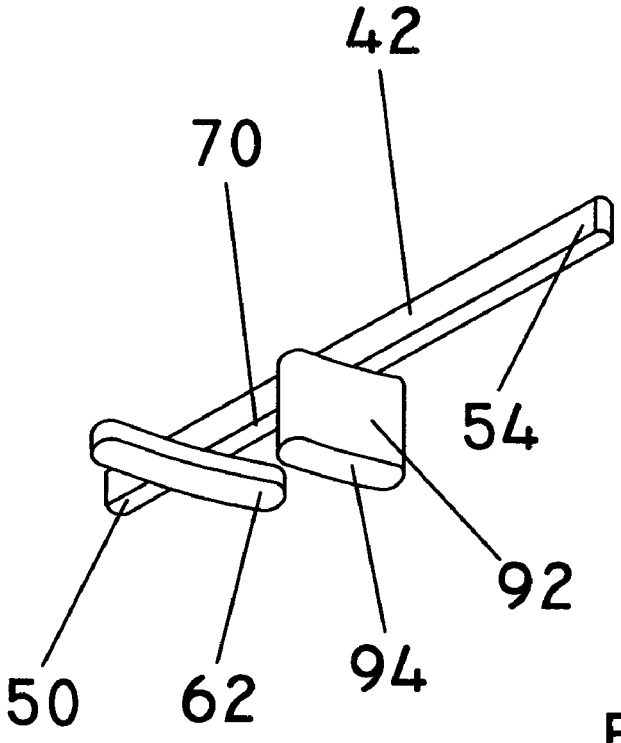
FIG. 9 is a perspective bottom view of the visual alignment indicator of the alternate embodiment of the adjustable alignment golf putter of the present invention Similar reference characters refer to similar parts throughout the several views of the drawings.

FIGS. 6 and 7 show an alternate embodiment of the lower putter head 24 of the adjustable alignment golf putter 20. With the exception of the indicator retention member 40, the various elements and structural components of the alternate embodiment are virtually the same as shown in FIGS. 2 through 5 and are therefore similarly numbers.

As best shown in FIG. 7, the indicator retention member 40 comprises a fastener or externally threaded set screw 86 partially disposed within a retention recess 88 and retention channel or passage 90 formed in the raised plate or putter foot 78 of the alignment support or base 36 and extending through the retention channel or passage 90 to engage the rear face or surface 92 of an arcuate or convex retention member 94 extending downwardly from the lower surface 64 of the elongated member 42 of the visual alignment indicator 38 into an arcuate or convex retention slot 96 disposed between the proximal end portion 54 of the elongated member 42 and the arcuate or convex keyway or guide recess 56 formed on the distal end portion 50 of the elongated member 42. So configured, the fastener or externally threaded set screw 86 snaps into and out of locking or securing engagement with the rear surface 92 of the arcuate or convex retention member 96

The arcuate or convex retention member 94 extends downwardly to a horizontal plane below the horizontal plane at the bottom of arcuate or convex key or guide member 62. Similarly, the depth of arcuate or convex retention slot 96 is greater than the depth of the arcuate or convex keyway or guide recess 56.

The bottom surface 98 of the alignment support or base 36 is inclined upward from the front to back thereof.

Alignment of the alternate embodiment is same as that previously described.

As shown in FIG. 3, a golf ball lifter cup 100 is formed on each side of the alignment support or base 36.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An adjustable alignment golf putter to compensate for a golfer's visual misalignment of the putter face to the target line between the optimum contact point on the putter face and the cup comprising an upper golf grip and a lower putter head attached to opposite end portions of a putter shaft, the putter head including a putter body having an outer putter face including a centrally disposed optimum contact point on one side thereof to strike a golf ball when putting and a visual alignment means disposed on the side opposite the putter face, said visual alignment means including a visual alignment base to support a visual alignment indicator movably positioned thereon in operative disposition relative to the optimum contact point to selectively align said visual alignment indicator on a line between the optimum contact point and the cup to compensate for the golfer's visual misalignment, said visual alignment means further comprises an alignment indicator guide to control the directional movement of the visual alignment indicator relative to the alignment base wherein said alignment indicator guide comprises an arcuate guide recess formed in the upper surface of said alignment support base and a corresponding arcuate guide member extending downwardly from said visual alignment indicator at least partially disposed within said arcuate guide recess.

2. The adjustable alignment golf putter of claim 1 wherein said arcuate guide member is symmetrically disposed on said visual alignment indicator and said arcuate guide recess is symmetrically disposed on said alignment base such that when said arcuate guide member is centered in said arcuate guide recess, said visual alignment indicator is substantially perpendicular to said putter face.

3. The adjustable alignment golf putter of claim 2 wherein said arcuate guide recess is slightly larger than said arcuate guide member to provide smooth movement or swing of said visual alignment indicator relative to said alignment base when adjusting or aligning said visual alignment indicator.

4. The adjustable alignment golf putter of claim 1 wherein said visual alignment indicator comprises an elongated member.

5. The adjustable alignment golf putter of claim 4 wherein a line or other alignment indicator is formed on the upper surface of said elongated member.

6. The adjustable alignment golf putter of claim 5 wherein said visual alignment indicator further includes a directional indicia formed on the distal end portion thereof and a pointer indicia formed on the proximal end portion thereof to align the putter face.

7. The adjustable alignment golf putter of claim 4 wherein said visual alignment indicator comprises a series of dots or other alignment indicator.

8. The adjustable alignment golf putter of claim 4 wherein said visual alignment indicator comprises an interrupted line.

9. The adjustable alignment golf putter of claim 1 wherein said alignment contact indicia is formed on the top surface of said putter body in vertical alignment relative to said centrally disposed optimum contact point.

10. The adjustable alignment golf putter of claim 1 wherein said visual alignment indicator comprises a visual indicia formed on said putter body and a visual indicia formed on said visual alignment indicator.

11. The adjustable alignment golf putter of claim 10 wherein said visual indicia formed on said putter body comprises a dot formed on the top surface of said putter body in substantially vertical alignment relative to said centrally disposed optimum contact point.

12. The adjustable alignment golf putter of claim 11 wherein said visual indicia formed on said visual alignment indicator is angularly adjustable relative to said dot such that when properly aligned therewith a straight line therebetween is aligned with the intended or target line.

13. An adjustable alignment golf putter to compensate for a golfer's visual misalignment of the putter face to the target line between the optimum contact point on the putter face and the cup comprising an upper golf grip and a lower putter head attached to opposite end portions of a putter shaft, the putter head including a putter body having an outer putter face including a centrally disposed optimum contact point on one side thereof to strike a golf ball when putting and a visual alignment means disposed on the side opposite the putter face, said visual alignment means including a visual alignment base to support a visual alignment indicator movably positioned thereon in operative disposition relative to the optimum contact point to selectively align said visual alignment indicator on a line between the optimum contact point and the cup to compensate for the golfer's visual misalignment and a visual alignment indicator retention member to selectively secure said visual alignment indicator in position relative to the optimum contact point wherein said indicator retention member comprises a fastener at least partially disposed within a retention recess and a retention channel formed in a raised putter foot of said alignment base extending through said channel to engage a rear face of an arcuate retention member extending downwardly from said visual alignment indicator into an arcuate retention slot.

14. The adjustable alignment golf putter of claim 13 wherein the arcuate retention slot is disposed between the proximal end portion of said visual alignment indicator and said arcuate guide recess formed on said visual alignment indicator.

15. The adjustable alignment golf putter of claim 14 wherein said depth of said arcuate retention slot is greater than the depth of said arcuate guide recess.

16. An adjustable alignment golf putter to compensate for a golfer's visual misalignment of the putter face to the target line between the optimum contact point on the putter face and the cup comprising an upper golf grip and a lower putter head attached to opposite end portions of a putter shaft, the putter head including a putter body having an outer putter face including a centrally disposed optimum contact point on one side thereof to strike a golf ball when putting and a visual alignment means disposed on the side opposite the putter face, said visual alignment means including a visual alignment base to support a visual alignment indicator movably positioned thereon in operative disposition relative to the optimum contact point to selectively align said visual alignment indicator on a line between the optimum contact point and the cup to compensate for the golfer's visual misalignment, said visual alignment means further comprises an alignment indicator guide to control the directional movement of the visual alignment indicator said relative to the alignment base wherein said alignment indicator guide comprises a guide recess formed in the upper surface of said alignment support base and a corresponding guide member extending downwardly from said visual alignment indicator at least partially and slideably disposed within said guide recess.

* * * * *